United States Patent [19]

Abuyama

[11] Patent Number: 4,678,316

[45] Date of Patent: Jul. 7, 1987

[54] IMAGE FORMING APPARATUS ADAPTED TO ENTER AN INTERRUPT COPYING MODE AND AN ENERGY SAVING MODE

[75] Inventor: Yasuo Abuyama, Ebina, Japan

[73] Assignee: Kabushiki Kaisha Toshiba, Kawasaki, Japan

[21] Appl. No.: 873,851

[22] Filed: Jun. 10, 1986

Related U.S. Application Data

[63] Continuation of Ser. No. 679,078, Dec. 6, 1984, abandoned.

[30] Foreign Application Priority Data

Dec. 20, 1983 [JP] Japan ..... 58-238808

[51] Int. Cl.[4] ..... G03G 15/00

[52] U.S. Cl. ..... 355/14 C; 355/3 R; 355/14 R

[58] Field of Search ..... 352/3 R, 14 R, 14 C, 352/14 FU

[56] References Cited

U.S. PATENT DOCUMENTS 4,099,860 7/1978 Connin ..... 355/14 C 4,372,675 2/1983 Sahay ..... 355/14 FU 4,474,456 10/1984 Kobayashi et al. ..... 355/14 FU 4,497,568 2/1985 Komiya et al. ..... 355/14 FU X

*Primary Examiner*—A. C. Prescott

*Attorney, Agent, or Firm*—Oblon, Fisher, Spivak, McClelland & Maier

[57] ABSTRACT

A copying or printing machine including a microcomputer having a random access memory in which a set of coded signals may be written in and read out; a read only memory having a sequence control program for accomplishing a copying or printing operation; a processing unit operative for reproducing a copy of an original; a power supply for energizing the machine; and a power reducing device for reducing electric power to be supplied to an image fixing portion of the machine by the power supply so that less electric power is consumed than in normal standby status. If an interrupt mode is established during a copy run, copying conditions relevant to the previous copy run are stored in the RAM and an interrupt copy run is performed. During the interrupt mode, the power reducing device is inhibited from reducing electric power to be supplied to the image fixing portion of the machine.

2 Claims, 10 Drawing Figures

IMAGE FORMING APPARATUS ADAPTED TO ENTER AN INTERRUPT COPYING MODE AND AN ENERGY SAVING MODE

This application is a continuation of application Ser. No. 679,078 filed Dec. 6, 1984, now abandoned.

BACKGROUND OF THE INVENTION

1. Field of the Invention

This invention relates to an image forming apparatus including a copy machine and printer, which are provided with a interrupt copying function and an energy saving function.

2. Description of the Prior Art

A conventional copying machine includes an image forming device for forming a toner image on a copy sheet and a fuser for fixing the toner image on the copy sheet. However, in use of a heat roll fuser, a large heat capacity is required, and it takes much time to heat the fuser to an applicable temperature. Therefore, normally the fuser is maintained at the applicable temperature so as to permit copying operation to occur at any time.

However, in the conventional copying machine as mentioned above, it is impossible to use electric power effectively. To avoid this problem, another conventional copying machine has been provided with an energy saving function whereby the machine is set in a standby status and the temperature of the fuser is maintained lower than the applicable temperature.

However, the copying machine is generally provided with an interrupt copying function which, by setting an interrupt copying mode during one copy run, permits performing of another copy run.

Accordingly, when the energy saving function is set during the interrupt copying mode, the data related to the copying condition of the previous run is cleared from a memory where it is stored. As the result, it becomes impossible to complete the interrupted copy run after an interrupting run is finished.

SUMMARY OF THE INVENTION

Accordingly, it is an object of the present invention to provide an image forming apparatus which prevents setting and entry into an energy saving mode during operation in an interrupt copying mode.

Another object of the present invention is to provide an image forming apparatus which is convenient to use and which is excellent in operability.

These and other objects are achieved by providing a novel image forming apparatus including means for forming an image on a recording medium, means for supplying electric power for energizing the image forming means in normal standy status, means for establishing an interrupt mode of operation where the image forming means interrupts one copy run and executes another copy run to be performed, means for reducing the electric power to be supplied to the image forming means by said supplying means so that less electric power is consumed than in the normal standby status, and means for inhibiting the reduction of electric power by the reducing means during operation in the interrupt mode.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
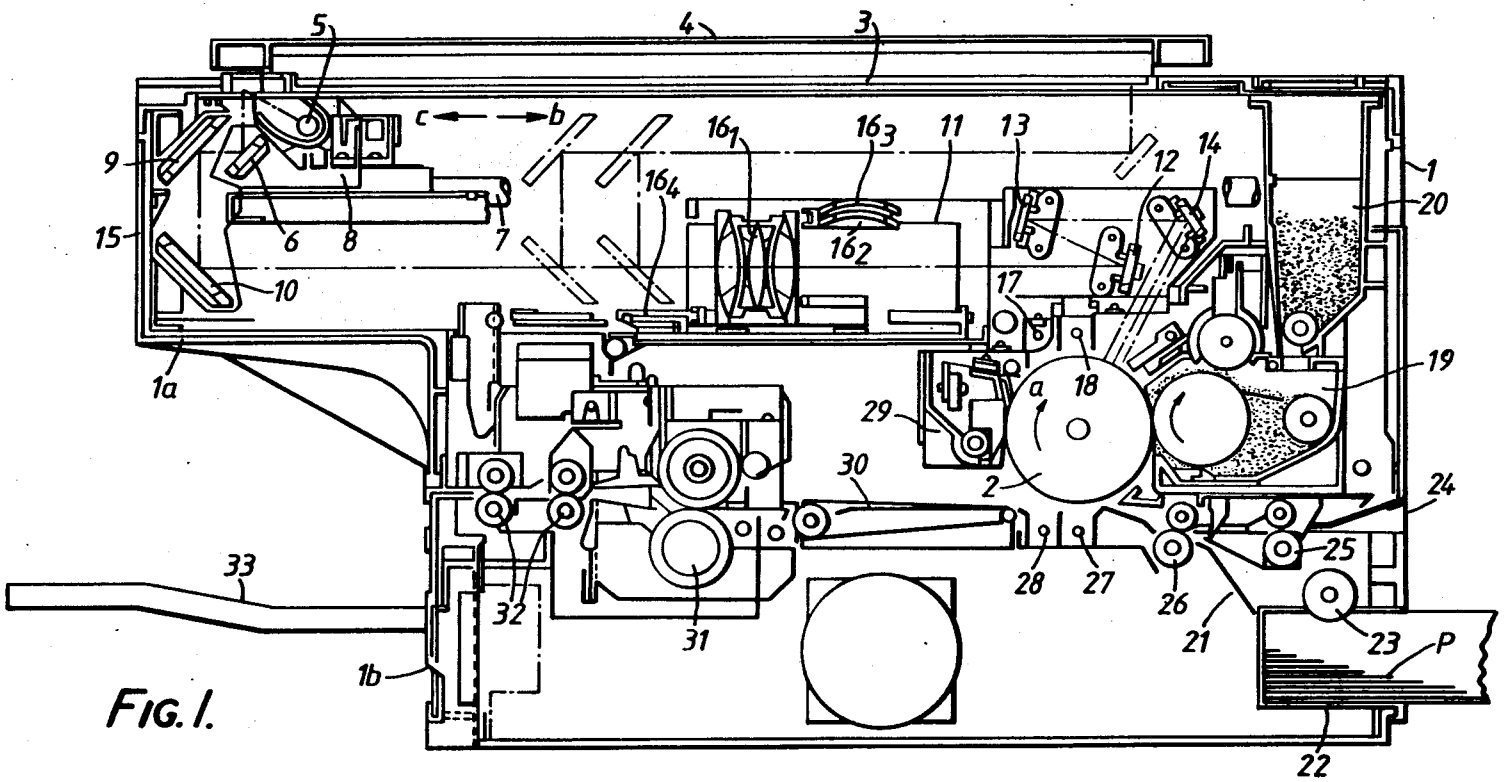
FIG. 1 is a front view of the inside of a copying machine incorporating the present invention.

Referring now to the drawings, wherein like reference numerals designate identical or corresponding parts throughout the several views, FIG. 1 shows an embodiment of the copying machine to which the present invention is applied. In the middle part of the casing 1 of the copying machine, there is provided a drum 2 having a photosensitive layer thereon, which is rotated in the direction of arrow a as shown in the drawing. On the upper part of the casing 1, an original holder 3 having a transparent glass plate for setting an original to be copied is fixed. On the original holder 3, an original cover 4 for pressing the original to the original holder 3 is provided in such a manner as to be freely opened and closed in relation to the original holder 3. An exposure lamp 5 and a mirror 6 for illuminating the original are provided below the original holder 3. The exposure lamp 5 and the mirror 6 are held by the first carriage 8 which reciprocates in the direction of arrows b and c in the drawing. By movement of the first carriage 8, the original can be scanned from one end to the other end.

Light reflected from the original illuminated by the exposure lamp 5 is led onto the surface of the drum 2 through the mirror 6 and mirrors 9 and 10 and further a lens unit 11 and fixed mirrors 12, 13, and 14, whereby a slit-shape image of the original is continuously projected on the drum surface. The mirrors 9 and 10 are held by the second carriage 15 which is moved with the first carriage 8 at half the speed of the first carriage. Then lens unit 11 includes a main lens $\mathbf{16}_1$ movable in the direction of arrows b and c and auxiliary lenses $\mathbf{16}_2$, $\mathbf{16}_3$ and $\mathbf{16}_4$ for changing magnification, which change the composite focal distance of the whole lens. Further, the first carriage 8 and the second carriage 15 are respectively driven and moved by a scanning motor (not shown in the drawing). The exposure lamp 5, mirrors 6, 9 and 10 lens unit 11, and mirrors 12–14 define an optical system.

Around the drum 2, an erase lamp 17 for discharging charge remaining on the surface of the drum 2 and a charger 18 for charging the surface of the drum 2 are provided. An electrostatic latent image is formed on the surface of the drum 2 by erasing the remaining charge on the drum surface and then exposing the drum surface to an optical image by means of the optical system. A developing device 19 is provided for developing the electrostatic latent image on the drum 2 by means of a toner. Further, a toner hopper 20 for supplying toner to the developing device 19 is provided.

Also, there is provided a feeder 21 for supplying copying paper to the lower part of the drum 2. On the feeder 21, there are provided a paper cassette 22 which is mountable on the right side of the casing 1, where a copying paper P is stored, and a feed roller 23 for taking out the copying paper P one by one from the paper cassette 22. Further, on the upper part of the paper cassette 22, there are provided a sheet bypass 24 supplying the copying paper manually and a feed roller 25 for transporting forwardly the copying paper fed from the sheet bypass 24. In addition, register rollers 26 are provided for transporting the copying paper fed from the paper cassette 22 or the feed roller 25 to an image transferring station.

Also, there are provided a transfer charger 27 for transferring the toner image formed on the surface of the drum 2 to the copying paper fed by the register roller 26 and a separating charger 28 for separating the copying paper with transferred image from the surface of the drum 2. Further, a cleaning device 29 for recovering the toner remained on the surface of the drum 2 is provided. In addition, there is provided a transportation device 30 for transporting the copying paper which is separated from the drum 2 and on which surface the toner image is carried. At a terminal part of the transportation device 30, there is provided a heat roller 31 acting as a fuser for fixing the toner image held on the transported copying paper. The fixed copying paper is discharged by a discharge roller 32 in a receiving tray 33 provided outside of the casing 1.

The casing 1 is divided into two units, an upper unit 1*a* and a lower unit 1*b*, with the transportation passage 30 serving as a border line. The units 1*a* and 1*b* are supported at one end and the upper unit 1*a* can be opened at a fixed angle. The upper unit 1*a* includes the drum 2, the optical system, the charger 18, the developing device 12, the upper side rollers of the feed roller 25 and the register roller 26, the cleaning device 29, and the upper side rollers of the heat rollers 31 and the discharge roller 32. The lower unit 1*b* includes the paper cassette 22, the feed roller 23, the lower side rollers of the feed roller 25 and the register roller 26, the chargers 27 and 28, and transportation device 30, the lower side rollers of the heat roller 31 and the discharge roller 32, and the receiving tray 33.

Figure 2:
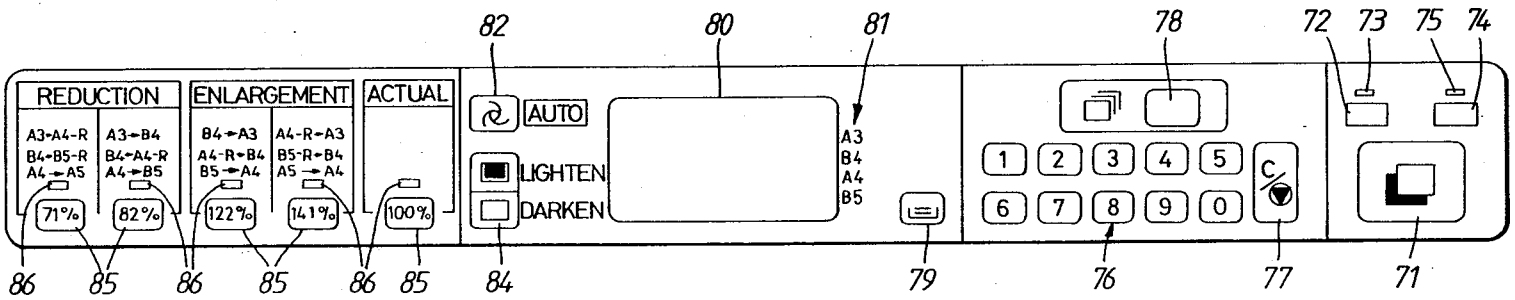
FIG. 2 is a front view of the operating panel of the copying machine shown in FIG. 1.

FIG. 2 shows the operating panel, including a print key 71 for starting copying operation, an interrupt key 72 for specifying an interrupt mode for performing interrupt copying, and interrupt indicator 73 which is lighted when the interrupt mode is specified, an energy saving key 74 for specifying an energy saving mode, an energy saving display 75 which is lighted when the energy saving mode is specified, digital keys 76 for setting the copy quantity, and a CLEAR/STOP key 77 for clearing the set quantity or for stopping copying operation.

Further, there are provided a quantity indicator 78 for indicating the copy quantity, a copying paper selection key 79, a liquid crystal display 80 for indicating various conditions such as copying conditions, and a size display 81 where a designation for the selected paper size (for example, A3, B4, A4, B5) is displayed. Further, there are provided an automatic exposure key 82 for selecting an automatic exposure mode where the optimum copy density can automatically be obtained, a lighten key 83 for lightening copy density and a darken key 84 for darkening copy density. Keys 83 and 84 thus permit selecting a manual exposure mode where a desired copy density can be selected and also selecting of the copy density. Also provided are magnification establishment keys 85 for setting the copy magnification (for examples, 71%, 82%, 122%, 141%, 100%), and magnification displays 86 which are lighted when respective of the magnification setting keys 85 are pressed.

Figure 3:
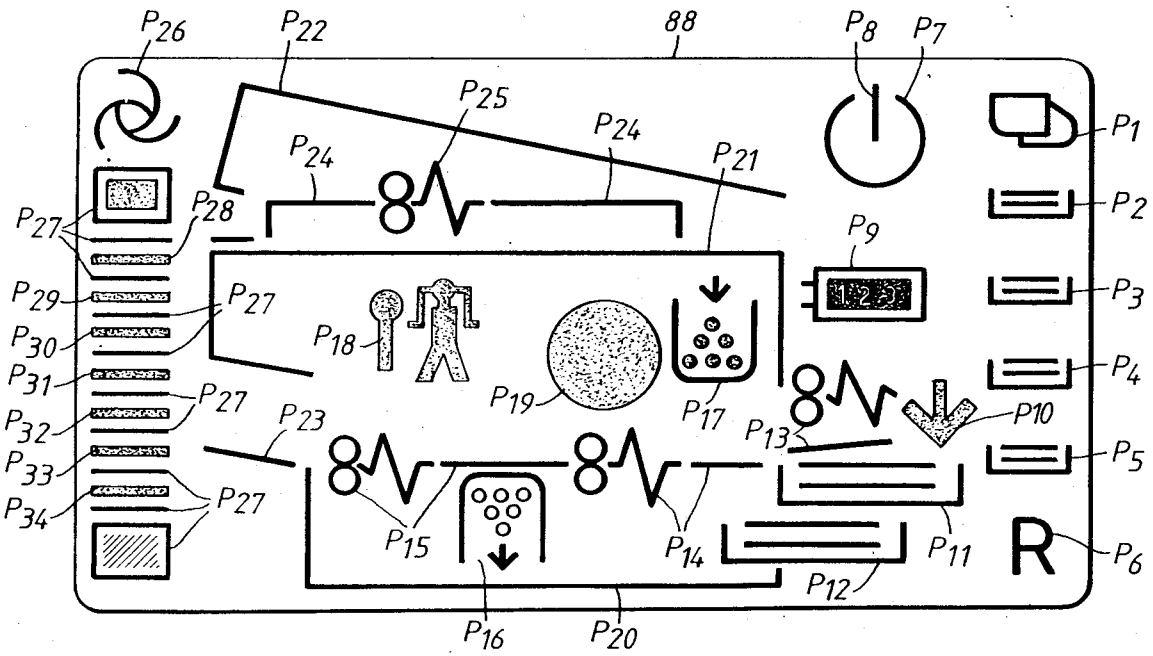
FIG. 3 is a front view of the display panel of the copying machine shown in FIG. 1.

FIG. 3 shows locations of the various display segments of the liquid crystal display 80. In the drawings, numeral 88 designates a liquid crystal display panel, reference $P_1$ designates a display pattern indicated manually feedable conditions, references $P_2$–$P_5$ designate display patterns indicating the size of the copying paper stored in the paper cassette selected with the size display 81, and reference $P_6$ designates a display pattern (letter R) indicating that the copying paper is set to be transported along the longitudinal direction.

Further, references $P_7$ and $P_8$ designate display patterns indicating if the copying machine is ready for copying. The display pattern $P_7$ alone indicates that the machine is ready for copying and the display pattern $P_7$ and $P_8$ indicate that the machine is warming up. Reference $P_9$ designates a display pattern indicating that no copying paper is present in the paper cassette. Reference $P_{11}$ designates a display pattern indicating that a paper cassette is optionally mounted. Reference $P_{12}$ designates a display pattern indicating that the paper cassette 22 is mounted. Reference $P_{13}$ designates a display pattern indicating that misfeed arises at manual paper feeding, and reference $P_{14}$ designates a display pattern indicating the occurrence of paper clogging or misfeed near the feeder 21.

Further, reference $P_{15}$ designates a display pattern which is displayed together with the display pattern $P_{14}$ to indicate a miss-separation of the copying paper from the drum 2 and paper clogging at the entrance of the heat roller 31. Patterns $P_{14}$ and $P_{15}$ are displayed singly to indicate paper clogging at the outlet of the heat roller 31. Reference $P_{16}$ designates a display pattern indicating that the toner recovered by the cleaning device 29 is full, and reference $P_{17}$ designates a display pattern indicating that no toner is present in the toner hopper 20. Reference $P_{18}$ designates a display pattern indicating a failure in the copying machine. Reference $P_{19}$ designates a display pattern indicating the drum 2. References $P_{20}$, $P_{21}$ and $P_{22}$ designate display patterns indicating the casing 1. Reference $P_{23}$ designates a display pattern indicative of the receiving tray 33. Reference $P_{24}$ designates a display pattern indicating that the original transportation device is mounted. Reference $P_{25}$ designates a display pattern indicating paper clogging in the original transportation device. Further, reference $P_{26}$ designates a display pattern indicating that the copying machine is in an automatic exposure mode. Reference $P_{27}$ designates a display pattern for displaying a scale which shows the level of the copy density selected in the manual exposure mode. References $P_{28}$–$P_{34}$ designate display patterns indicating the copy density selected in the manual exposure mode, which are displayed selectively together with the display pattern 27 to show that any of seven density grades is selected.

Figure 4:
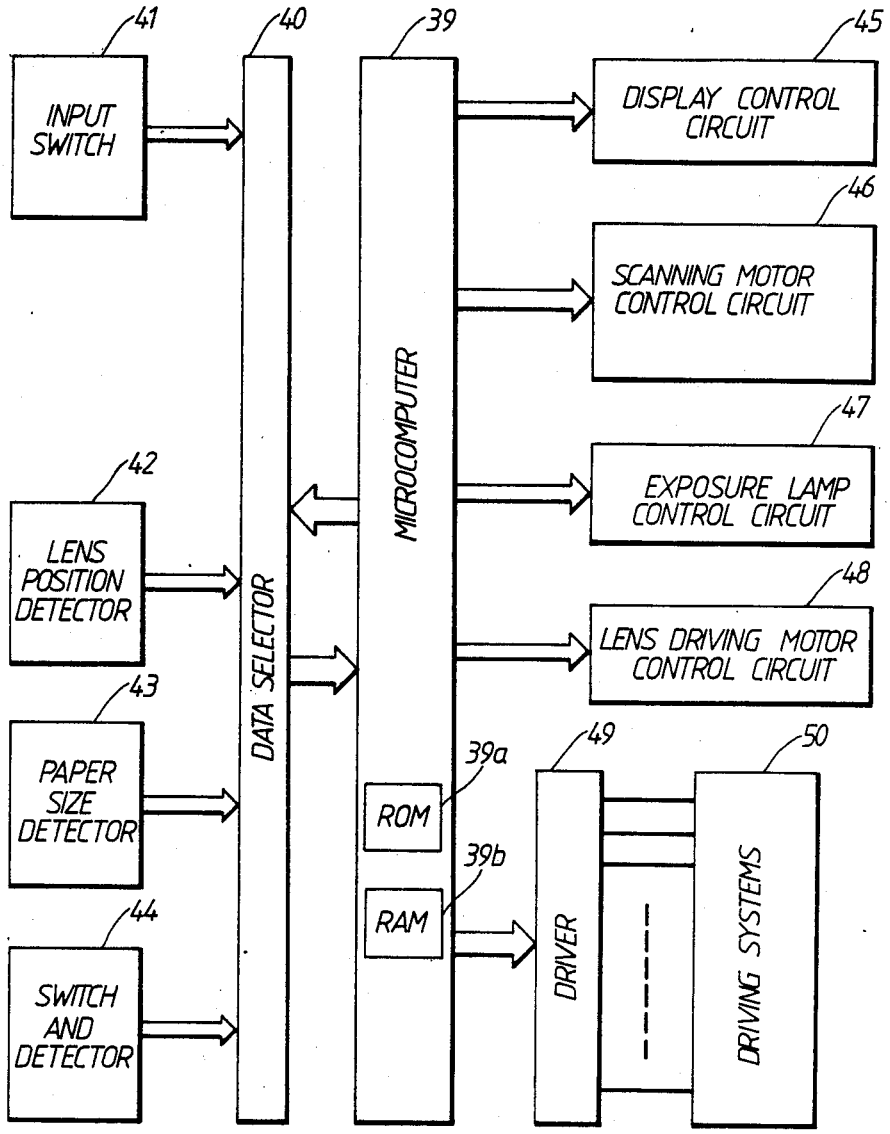
FIG. 4 is a schematic block diagram of the electric control system of the copying machine shown in FIG. 1.

FIG. 4 is a block diagram showing an electric control circuit for the copying machine shown in FIG. 1. A microcomputer 39 controls the whole copying machine and serves as a main controller. The microcomputer 39 is provided with ROM 39*a* which stores a control sequence program for controlling operation of the copying machine, a RAM 39*b* for storing data in copying conditions, and processing units. The input side of the microcomputer 39 is respectively connected to an input switch 41 for various keys on the operating panel, a lens position detecting switch 42 for detecting the position of the main lens $16_1$, a paper size detecting circuit 43, and another switch and detector 44 through a data selector 40. On the other hand, the output side of the microcomputer 39, is respectively connected to the liquid crystal display 80 on the operating panel and a display control circuit 45 for controlling various displays, a control circuit 46 of a scanning motor for driving carriages, an exposure lamp control circuit 47 for controlling the exposure lamp 5, and a control circuit 48 of the lens motor for moving the main lens $16_1$. Further, the output side of the microcomputer 39 is connected to various drive systems 50, such as includes solenoids and clutches, through the intermediary of drivers 49.

Figure 5:
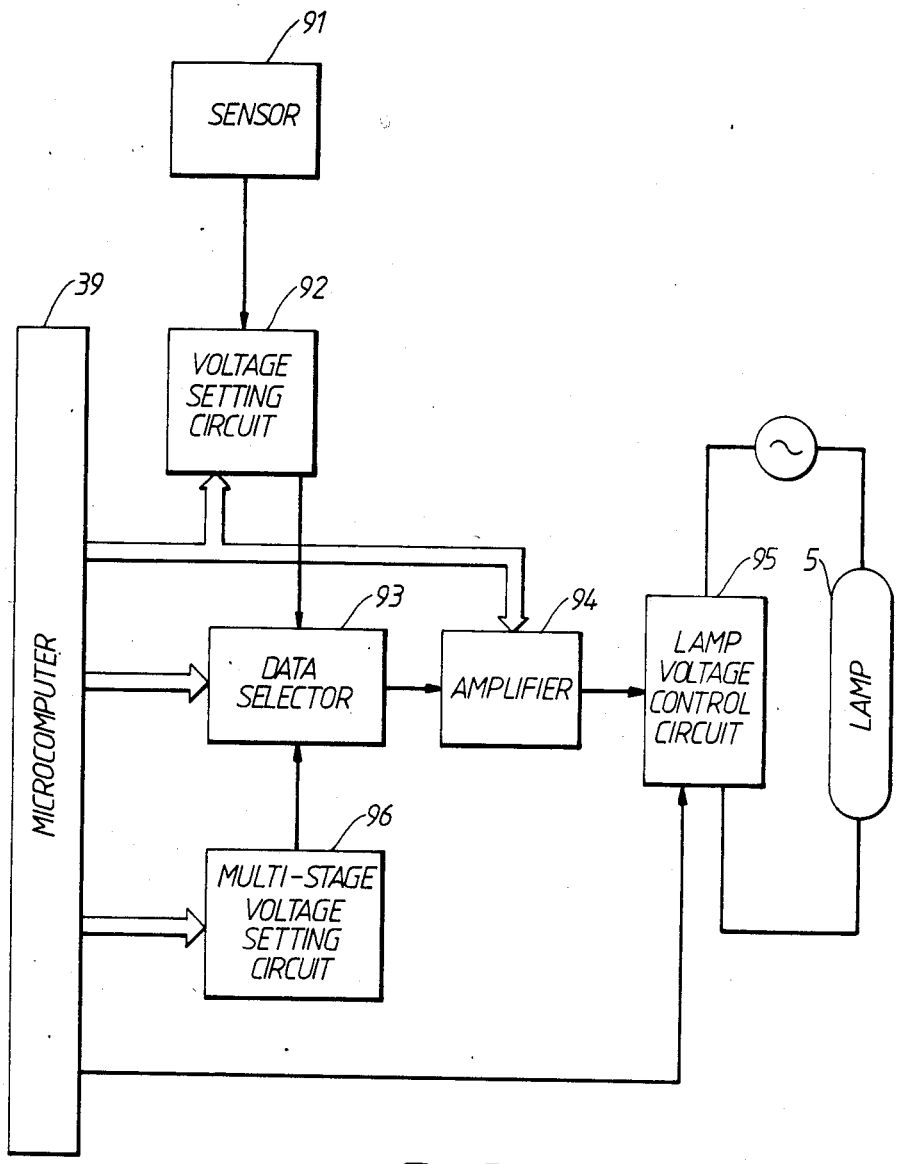
FIG. 5 is a block diagram of the exposure control circuit of the copying machine shown in FIG. 1; and FIGS. *6a, 6b, 7a, 7b* and 8 are flow charts which explain operation during power on operation, copying operation, and the energy saving operation of the copying machine according to the invention, respectively.

FIG. 5 is a schematic block diagram of the exposure lamp control circuit 47 shown in FIG. 4. That is, in an automatic exposure mode, the quantity of the light of the exposure lamp 5, which is reflected from the original is detected by an original density sensor 91 which supplies an output signal indicative of the density of the original to a voltage setting circuit 92. The voltage setting circuit 92 outputs an analog voltage so as to increase the voltage supplied to the exposure lamp 5 when the reflected light quantity is small and to decrease the voltage supplied to the lamp 5 when the reflected light quantity is large. The signal to be output is sent to an amplifier 94 through an analog data selector 93, and the amplified signal is applied to a lamp voltage control circuit 95 as a reference voltage. As the result, the lamp voltage control circuit 95 controls the supply voltage to the exposure lamp 5 so that a contrast light quantity is reflected from the original. On the other hand, in a manual exposure mode, the analog data selector 93 outputs a signal from a multi-stage voltage setting circuit 96, which supplies to the analog data selector 93 a voltage corresponding to the exposure density of one of seven grades selected in the manual exposure mode. Accordingly, in this case, a specified voltage is supplied to the exposure lamp 5 irrespective of the original density. Further, at three of the seven manually selected density grades, where the exposure lamp 5 darkens, the voltage is set so that incremental changes of light quantity are smaller than the incremental changes in light quantity occurring under conditions of relatively high lamp brightness. Also, the light quantity of the exposure lamp 5 is adjusted according to the copy magnification to be set.

Figure 6A:
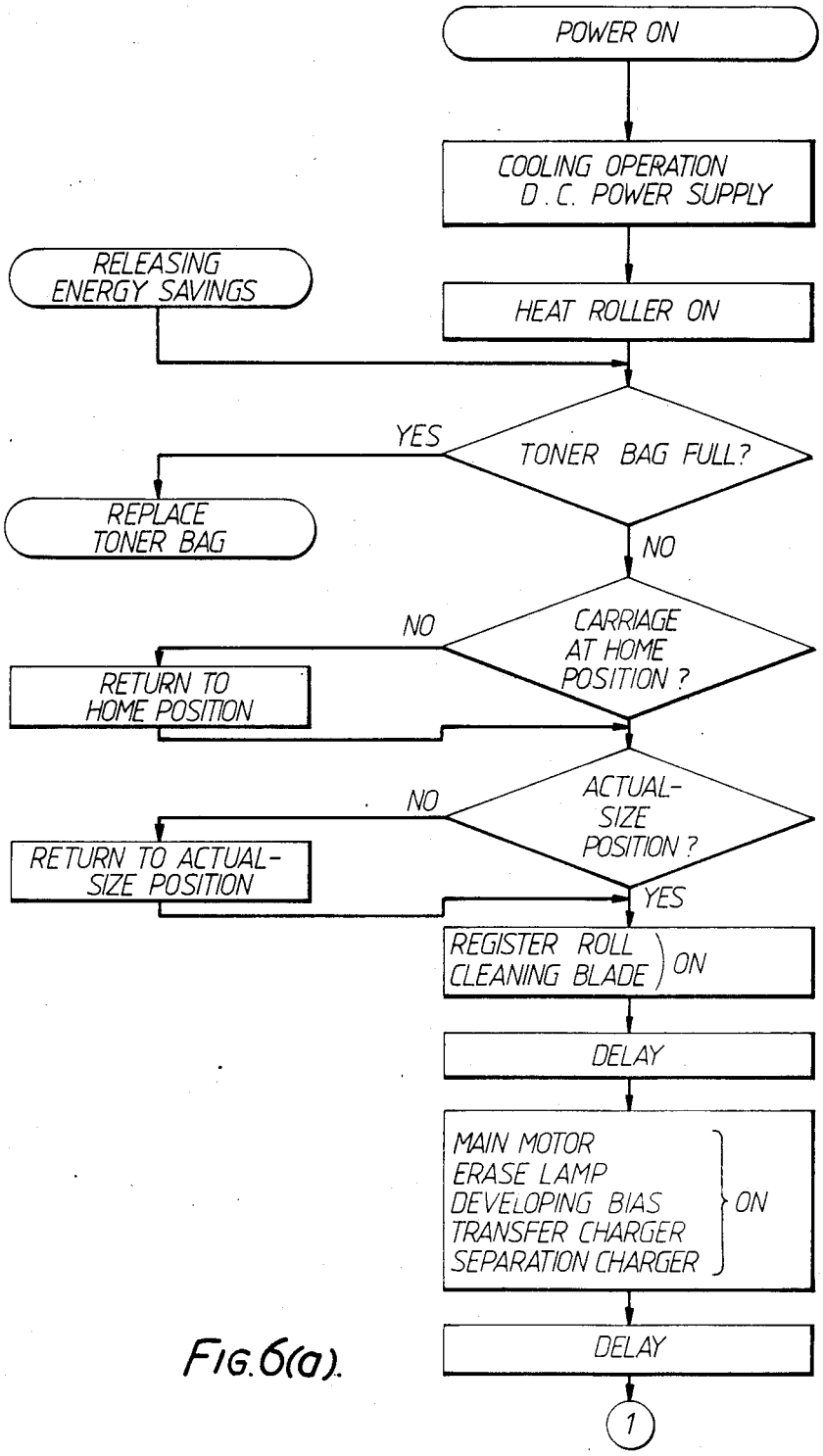
Figure 6B:
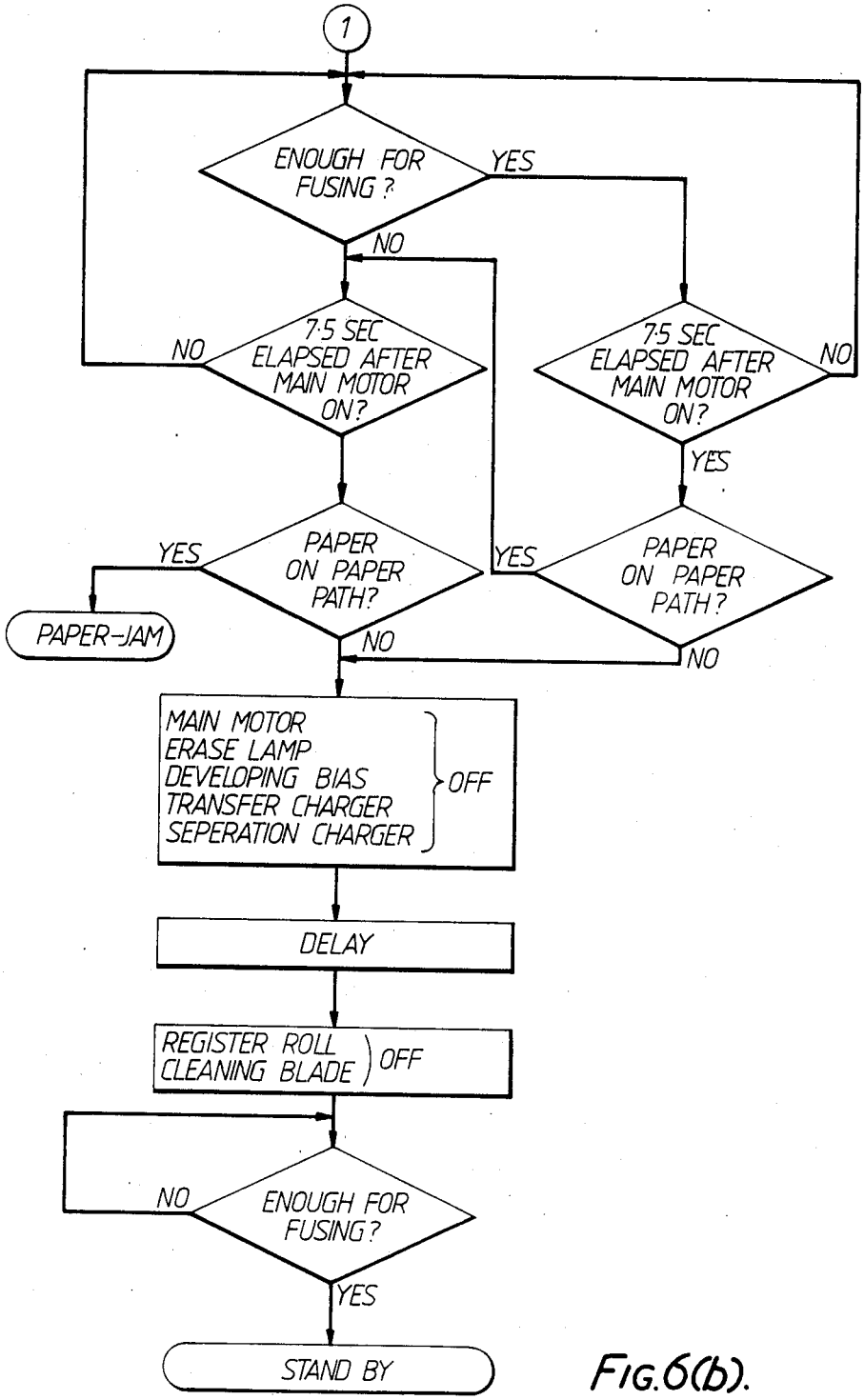

Referring to the flow charts shown in FIG. 6(*a*) and (*b*), operation from power on to completion of preparation will be explained. When the power supply is turned on, a ventilating fan (not shown in the drawing) is activated to start internal cooling of the machine, and DC power is supplied to the control circuit. Next, the heater of the heat roller 31 is charged and heating of the heat roller 31 is performed. Next, a recover toner storing bag in the cleaning device 29 is checked by a toner full detector (not shown in the drawing). If this is full, it is displayed and if not, the copying machine returns to a normal state to proceed with the operation.

First, the carriages are checked to determined if they are at the initial scan positions. If not, the carriages are returned to the initial positions. Next, the main lens $16_1$ of the lens unit 11 is checked by operation of the lens position detecting switch 42 to determine if it is at the actual magnification position. If not, the main lens $16_1$ is returned to the to the actual magnification position. Then, the register roller 26 is rotated and the cleaning blade of the cleaning device 29 is pressed to the surface of the drum 2. After pressing of the cleaning blade is finished, the main motor, the erase lamp 17, the developing bias, the transfer charger 27, and the separation charger 28 are operated. This state is continued for a fixed time (for example, about 7 seconds), and if a copying paper is present on the paper transportation passage in the copying machine, it is discharged in the receiving tray 33.

In the meantime, when the heat roller 31 reaches a temperature suitable for fixing toner but the paper detector on the paper transportation passage does not yet detect the presence of copying paper, the copying machine is considered to be in a ready state at the point when the heat roller 31 reaches the above-noted fixing temperature. When a copying paper is present on the paper transportation passage, a malfunction indication is displayed. Next, after the main motor, the erase lamp 17, the developing bias, the transfer charger 27, and the separation charger 28 become off and the main motor is stopped completely, the cleaning blade and the register roller stop operation. Thereafter, the machine waits until the heat roller 31 reaches the above-noted fixing temperature and at that point enters a standby state.

Figure 7A:
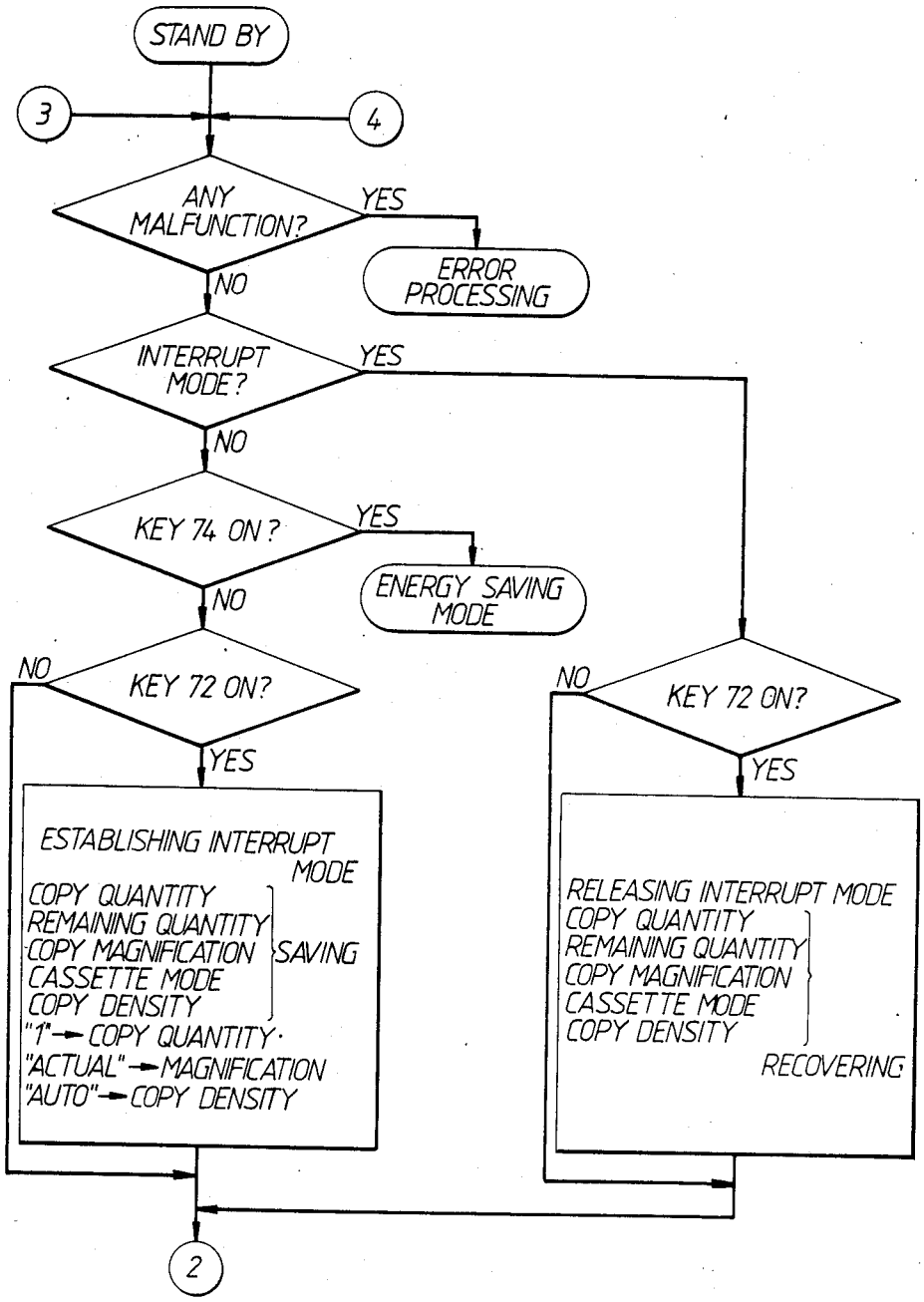
Figure 7B:
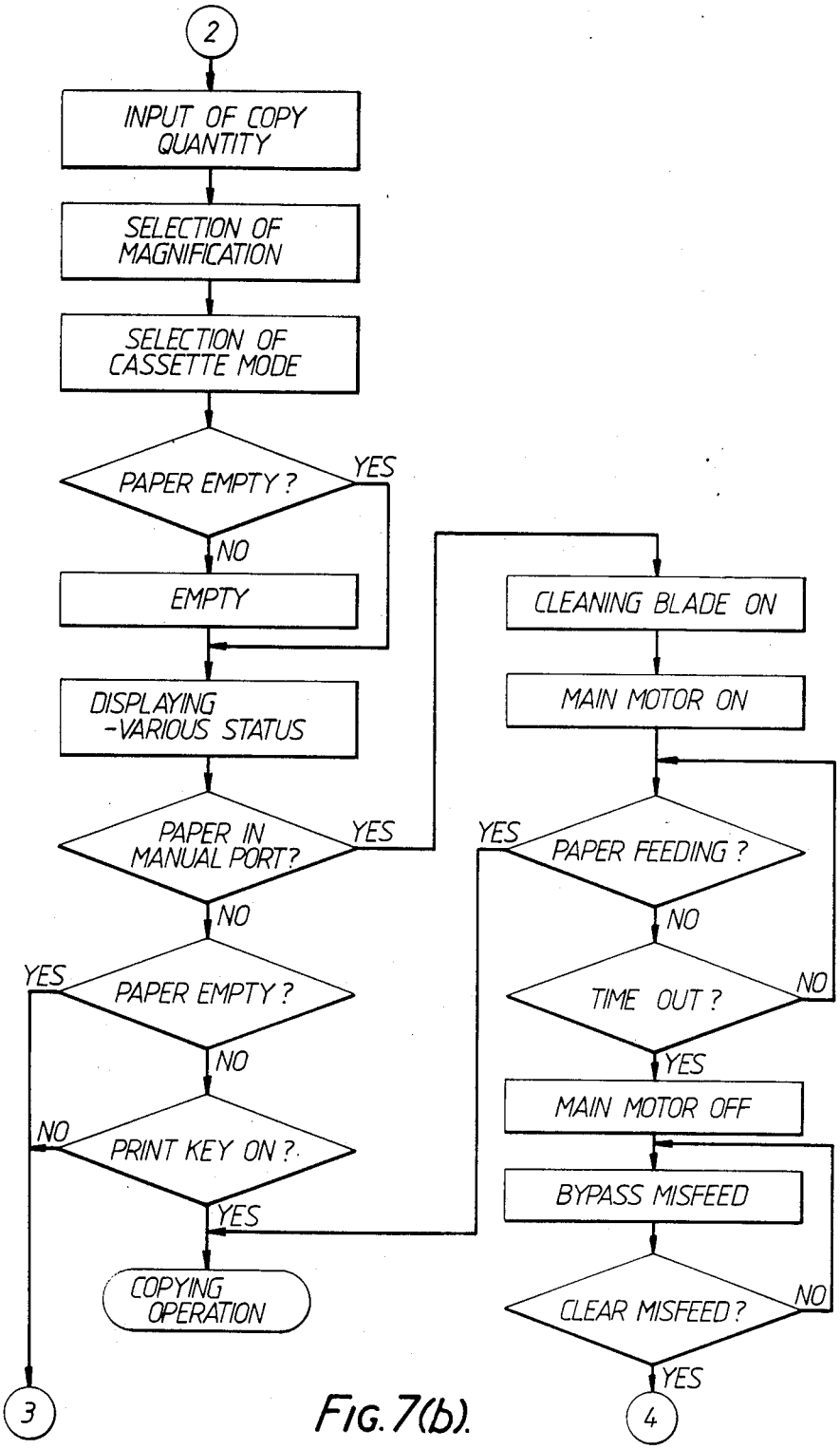

Next, referring to the flow charts shown in FIGS. 7(*a*) and (*b*), the operation prior to performing a copy run is explained. First, the copying machine is checked to see if any abnormality exists. If so, a countermeasure is taken, and if not, it is determined if operation is to proceed in an interrupt mode. If not, the energy saving key 74 is checked to see if it is on. If on, an energy saving mode (to be described in detail after) is started, and if the key 74 is not on, the interrupt key 72 is checked to see if it is pressed. That is, even if the energy saving key 74 is pressed when the machine is in an interrupt mode, operation in the energy saving mode is not started, but is only started if the energy saving key 74 is pressed when the machine is not in an interrupt mode. If operation in the interrupt mode is to proceed, as a result of having determined that the interrupt key 72 is pressed, operation in the interrupt mode is performed.

The interrupt key 72 is provided in the event that urgent copying is required to be performed. When the interrupt key 72 is pressed while copying is being performed, the microcomputer 39 interrupts the copying run, places the machine in an interrupt mode, and lights the interrupt display 73. At this time, for returning to and then continuously performing the interrupted copying run again, the microcomputer 39 transfers from a work area to a save area of the RAM 39*b* the pre-interrupt copying conditions data, such as copy quantity, remaining quantity, selection of copy magnification, selection of cassette, and selection of copy density. Simultaneously, it sets the interrupt copying conditions data in the work area of RAM 39*b*, such as, for example, to make the copying quantity one sheet, copy magnification actual, and selection of copy density in the automatic exposure mode. In the example, it is impossible to perform multi-copying in the interrupt mode since the copy quantity is one sheet, but the quality display 78 is still displaying the remaining quantity in the copy run prior to entering the interrupt mode. After pressing of the interrupt key 72 to enter the interrupt mode, the copying machine proceeds to the next steps such as acceptance of setting of copy quantity. In entering the interrupt mode, as occurs by a first depressing of the key 72, the setting operation of the interrupt mode is not performed until the interrupt key 72 is first pressed and the machine then proceeds to the next interrupt data setting step. On the other hand, when the machine is already in the interrupt mode, if it is determined that the interrupt key 72 is again depressed a second time, then this is interpreted as a command to release the interrupt mode. That is, when the interrupt key 72 is pushed again during a time when the interrupt mode is set, the microcomputer 39 releases the interrupt mode and the interrupt display 73 goes out. At this time, the microcomputer 39 returns preinterrupt copying conditions data, which are stored in the save area of RAM 39*b*, to the work area of RAM 39*b* again and returns the interrupted copying run to the status before interruption to permit renewed continuances of the copying run. Thus, after releasing the interrupt mode, the machine proceeds to the next step. In this case, when in an interrupt mode it is determined that the interrupt key 72 has not been depressed a second time to release the interrupt mode, the machine proceeds to the next step without performing releasing of the interrupt mode.

As described above, the microcomputer 39 performs a copying operation according to the copying conditions set in the work area of RAM 39*b*. Next, as shown in FIG. 7(*b*), acceptance of setting copy quantity, of setting copy magnification, and of selecting cassette are performed. In selecting a cassette, the paper cassette 22 is selected unconditionally when an optional paper cassette is not set. When the optional paper cassette is set, the paper cas 22 or the optional paper cassette is alternately selected by operating the paper select key 79 on the operation panel. Then, after selection of a cassette is performed, it is checked if copying paper is present in the selected cassette. If copying paper is not present, this fact is displayed. If copying paper is present or supplied, various statuses are displayed. In the next step shown in FIG. 7(*b*), it is checked if a copying paper is in the manual feed port 24 to judge if manual copying is started. When a copying paper is present in the manual feed port 24, the blade solenoid is turned on and then the main motor is turned on. At this time, the feed roller 25 is rotated and the register roller 26 is stopped. Therefore, the copying paper is sent by the feed roller 25 to the register roller 26. By this feeding, the copying machine proceeds to copying processing. When the copying paper fed by the feed roller 25 does not reach the register roller 26 after rotating of the main motor for more than a fixed time, it is determined that an abnormality is present. In this event, the display indicates a manual misfeed, the main motor is turned off, and the user's attention is directed to the abnormality.

On the other hand, when no copying paper is determined to be present in the manual feed port 24, it is checked to see if the copying key is on. When on, copying processing proceeds, and when not on, operation is returned to the initial step and it is checked if an abnormality is observed in the copying machine.

Figure 8:
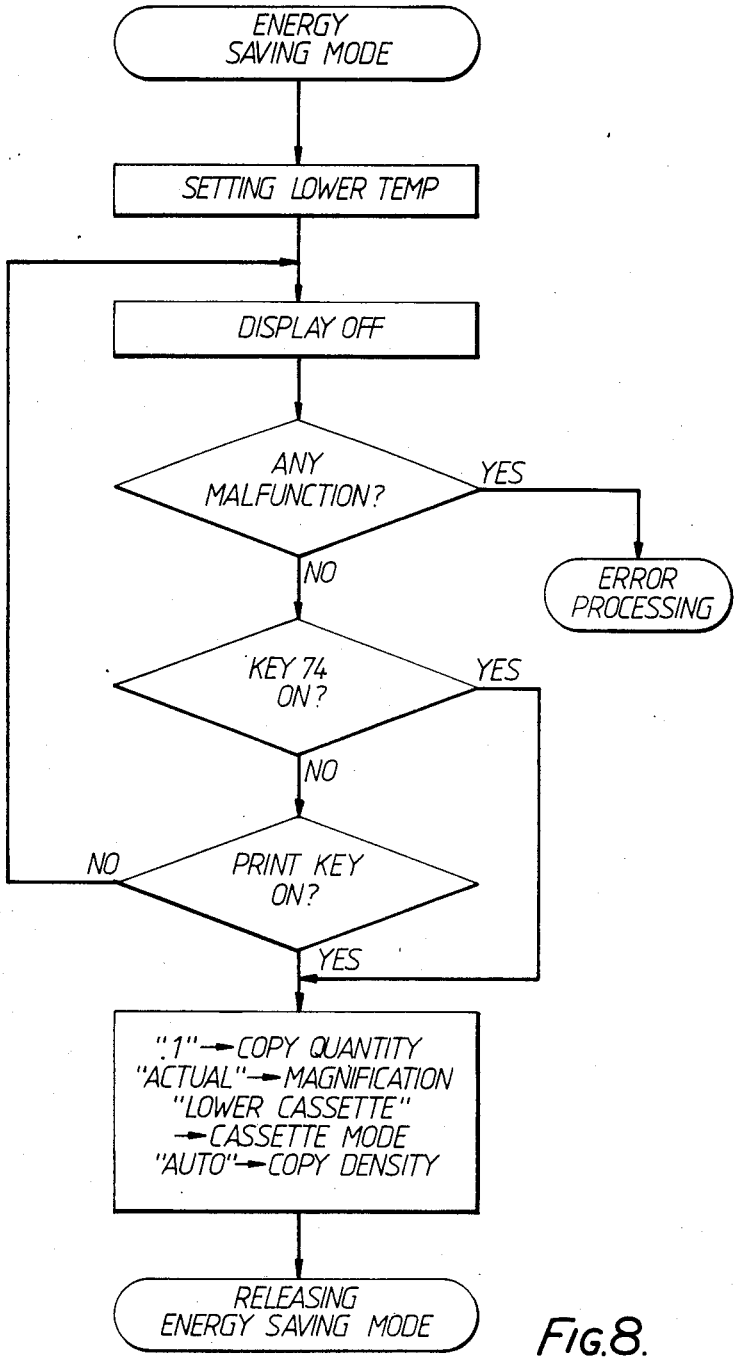

Referring now to FIG. 8, the operation in the energy saving mode is explained. In checking if the energy saving key 74 is depressed, i.e., "on" (See FIG. 7(*a*)), if so, a setting operation of the energy saving mode is performed. The purpose of using the energy saving key 74 is to attain an energy saving during operation of the copying machine. When energy saving key 74 is pushed during a copy run, the microcomputer 39 makes the machine enter an energy saving mode and lights the energy saving display 75. At this time, the microcomputer 39 sets the control temperature of the heat roller 31 to a temperature lower than the normal temperature and puts out all displays other than the energy saving display 75. Next, it is checked if an abnormality is observed in the machine. If so, a countermeasure is taken. While the energy saving mode is set, it is checked if the energy saving key 74 is on. When the energy saving key 74 is not on, it is checked if the print key 74 is on. When the print key 71 is not on, the machine returns to the step of putting out the displays and repeats the same operation as described above.

On the other hand, when the print key 71 or the energy saving key 74 is operated during operation in the energy saving mode, the energy saving mode is released and the copying conditions are set in that the copy quantity is made to be one sheet, copy magnification actual, selection of a copying paper the paper cassette 22, and selection of copy density in an automatic exposure mode.

After being released from the energy saving mode, the machine returns to the initial status after power is on. Namely, when the energy saving key 74 is pushed again, the microcomputer 39 releases the energy saving mode and puts out the energy saving display 75 and thus, the copying machine restarts normal operation. In this case, when an abnormality is present in the machine, as described before, the energy saving mode is not started even if the energy saving key 74 is pushed. Also, even in an energy saving mode, when an abnormaltiy is generated in the machine, the energy saving mode is released at that time and the source of the abnormality is displayed.

Next, the energy saving functions will be further explained. As described above, when the energy saving mode is set, all displays other than the display 75 go out and the temperature of the heat roller 31 is held at a lower temperature (for example, 150° C.) than the toner fixing temperature (for example, 190° C.). The time required for the copying machine to return to the conditions required for coying operation, when the energy saving mode is released, depends on the time required for the temperature of the heat roller 31 to reach the toner fixing temperature, i.e., about 30 seconds. This time is $\frac{1}{4}$ or less of the heating time required to heat the heat roller 31 from room temperature to the fixing temperature.

In the above-described embodiment, the copying conditions are set to the initial conditions when the energy saving mode is released. This is done because setting an energy saving mode means that an operator has no intention to use the copying machine for a little while. Releasing the energy saving mode means that the operator has an intention to use the copying machine again. Therefore, there is no direct relation between the copying conditions before the energy saving mode is set and those after it is released. It is rather normal for a different operator to use the copying machine after releasing of the energy saving mode. Therefore, the copying condition existing before setting the energy saving mode will most probably be different from the copying conditions to be set after releasing of the energy saving mode. Therefore, when the energy saving mode is released, the copying conditions at which copying will usually be performed are set. These copying conditions define the initial copying status and are termed a priority copying mode.

Next, the copying processing after the print key is pushed is explained. First, the register roller 26 is stopped. Next, the paper fed from the selected paper cassette is performed and the copying paper is sent to the register roller 26. The feeding operation is not performed at a manual feeding. Next, the charger 18 is turned on and the drum 2 is charged. Then, a carriage advance signal is given and the carriages are moved in the direction of arrow b in FIG. 1 and scanning of the original is started. The register roller 26 is rotated at a timing according to the required copy magnification, and the copying paper is sent to the transfer station so as to transfer the image formed on drum 2 to the copying paper.

The original is scanned by movement of the carriages and the reflected light from the original forms a light image on the drum 2 through the mirrors 6, 9 and 10, the lens unit 11 and the mirrors 12, 13 and 14 such that an electrostatic latent image corresponding to the image of the original is formed on the drum 2. This electrostatic latent image is developed by the developing device 19 and the toner image is transferred to the copying paper by the charger 27. The copying paper is then separated from the drum 2 by the separation charger 28, sent to the heat roller 31 by the transportation device 30, and the transferred image is fixed. Then, the fixed paper is discharged in the receiving tray 33 outside the casing 1 by the discharge rollers 32. The residual toner remained on the drum 2 after transfer is cleaned by the cleaning device 29. The drum 2 is discharged by the erase lamp 17 and the machine is prepared for the next image formation.

In the copy run, when the copying paper is transported by the register rollers 26 and the trailing end of the copying paper is detected by a paper detector provided before the register roller 26, the charger 18 is turned off and charging of the drum 2 is stopped. Then, the carriages are moved in the direction of arrow c in FIG. 1 and returned to the initial scan positions. At this time, the toner concentration in the developing device 19 is detected. When the toner concentration is reduced, the toner supply mechanism of the toner hopper is made to supply toner to the developing device 19 for a predetermined time. Further, after the carriages starts its backward movement, the exposure lamp 5 is turned off. The carriages stop movement when they are returned to the initial scan positions. Where multiple copies of an original are to be made, when the carriages move backward, the operation after turning on of the exposure lamp 5 is repeated.

When a copy run of a single sheet or of the last sheet in multi-copy copy run is finished, paper clogging is checked depending on the operating conditions of a discharge switch provided near the discharge roller 32. When a paper jam is detected as a result of this check, it is displayed. When no paper jam is detected, the main motor, the discharge lamp 17, the development bias, the transfer charger 27, and the separation charger 28 are turned off. When the main motor is completely stopped, the cleaning blade is removed from the drum 2 and the machine enters a standby mode. For the copy magnification, actual magnification is generally used. Accordingly, when copying operation is not performed for a predetermined time, when an energy saving mode is released, or when power supply is turned on, the copy magnification is automatically set to actual magnification in a priority copy mode. Also, the copy quantity is set by the digital keys 76 as described before. When the copy quantity is set, the value is displayed on the display 78 and stored in the work area of RAM **39*b* in the microcomputer 39. During copy run, the remaining quantity to be copied is displayed on the display 78. When the remaining copy is performed, the set quantity stored in the RAM 39*b* is displayed again on the display 78**. When the machine is not operated for a predetermined time, a priority copy mode is set where the set quantity is automatically set as one sheet.

Next, the manner of setting of the copy density will be explained. As described before, there are two modes for the copy density, one being the automatic exposure mode for permitting copying automatically at optimum density irrespective of the density of an original and the other being the manual exposure mode where a desired density set by the user can be obtained. For the manual exposure mode, the density of 7 grades can be selected and a desired density can be selected by the lighten key 83 and the darken key 84. That is, when in the automatic exposure mode the lighten key 83 or the darken key 84 is pushed, the machine enters the manual exposure mode and the center value of 7 grades of manual exposure mode, namely the 4th density from both ends, is selected and the display pattern $p_{31}$ lights. When the lighten key 83 is further pushed, selection is changed in a direction such that the copy density is lightened one grade every time the key 83 is pushed. Also, upon pushing of the light key 83 continuously for more than a predetermined time, selection of density is changed over in a direction where the copy density is lightened one grade for each interval of a predetermined time that the light key 83 is continuously pushed. In case of pushing of the darken key 84 a corresponding darker grade is selected. According to such a key operation as described above, the display patterns $P_{28}$–$P_{34}$ light and are controlled selectively and the selected copy density (exposure quantity) is visually displayed. Accordingly, when the automatic exposure key 82 is pushed, the automatic exposure mode is selected. Further, most copy runs can be performed in the automatic exposure mode, and the manual exposure mode is used only in copying a special original. For this reason, when copying operation is not performed for a predetermined time, when the energy save mode is released or when the power supply is turned on, the priority copy mode is automatically set and sets copy density to the automatic exposure mode.

The copying machine of the present invention has the construction as explained above. Accordingly, setting of the energy saving mode is prohibited even if the energy saving key 74 is pushed when the machine is in an interrupt mode and clearing of the stored data relevant to the copy run previous to the interrupt copy run is prevented. Therefore, even if the energy saving key 74 is erroneously pushed in the interrupt mode, the interrupt copy run can normally be continued.

In above embodiment, the invention is described in the example of a copying machine, but the invention is not limited thereto and can be applied to other image forming apparatus such as a printer or a facsimile machine, if it has interrupt image forming functions and energy saving functions.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus adapted to enter an interrupt copying mode and an energy saving mode comprising:

operator controlled means for applying the interrupt mode so as to interrupt a first copy run and execute a second copy run to be performed;

means for storing a copying condition data related to at least one of the first and second copy run;

means, responsive to the nterrupt mode, for setting the copying condition data related to the second copy run in exchange for the first copy run into said storing means;

means for forming an image on a recording medium in accordance with the copying condition data stored in said storing means;

means for supplying a first level of electric power being sufficient to energize said image forming means for image forming operation;

operator controlled means for establishing and terminating the energy saving mode wherein the electric power supplied to said image forming means is reduced to a second level lower than the first level so that less electric power is consumed than that for said image forming operation;

control means, responsive to said establishing and terminating means and controllingly connected to said storing means, for causing said storing means to store a predetermined copying condition data regardless of the first and second copy run in said storing means; and means for inhibiting the establishing of the energy saving mode during the interrupt mode set by said applying means so as to prevent said control means from setting the predetermined copying condition data in said storing means.

2. An image forming apparatus according to claim 1 wherein said energy saving mode establishing and terminating means comprises:

a print key for starting the image forming operation, said print key producing a control signal to release the energy saving mode upon being depressed during the energy saving mode.

* * * * *